United States Patent [19]

Grossiord

[11] Patent Number: 4,630,937

[45] Date of Patent: Dec. 23, 1986

[54] WATCHES OR THE LIKE EQUIPPED WITH A DISPLAY DEVICE OF THE DATE TYPE

[75] Inventor: Claude Grossiord, Annecy, France

[73] Assignee: S. T. DuPont, Paris, France

[21] Appl. No.: 786,273

[22] Filed: Oct. 10, 1985

[30] Foreign Application Priority Data

Oct. 31, 1984 [FR] France ..... 84 16702

[51] Int. Cl.[4] ..... G04B 19/00

[52] U.S. Cl. ..... 368/223; 368/28; 368/228

[58] Field of Search ..... 368/223, 226, 234, 228, 368/28

[56] References Cited

FOREIGN PATENT DOCUMENTS 2011614 3/1970 France .
530061 12/1972 Switzerland .
15009 11/1975 Switzerland .

*Primary Examiner*—Bernard Roskoski
*Attorney, Agent, or Firm*—John P. Morley

[57] ABSTRACT

The invention relates to a watch or the like equipped with a display device of the date type, wherein the symbols to be displayed are located on a mobile support (44) and are perceived by an observer through a window (36).

According to the invention, a bundle (38) of coherent optical fibers is mounted in said window such that one end of said bundle is disposed near the mobile support (44) while its other end is flush with a visible surface of an element of the watch.

12 Claims, 8 Drawing Figures

WATCHES OR THE LIKE EQUIPPED WITH A DISPLAY DEVICE OF THE DATE TYPE

The present invention relates to improvements to display devices of the date type used in devices designed to show the time such as, in particular, watches.

Ordinarily, these devices have a window provided in the dial of the watch, through which the user can observe the symbols to be displayed, disposed on a disk driven rotationally by the movement of the watch.

One major drawback inherent in this type of display resides, however, in the difficulty of perceiving the displayed symbols whenever the observer is not strictly on the axis of the window.

This drawback will be explained hereinbelow with reference to FIG. 1 of the attached drawings, the other drawings whereof illustrating embodiments of the invention, to which reference will be made in the rest of the present specification. In these drawings.

Figure 1:
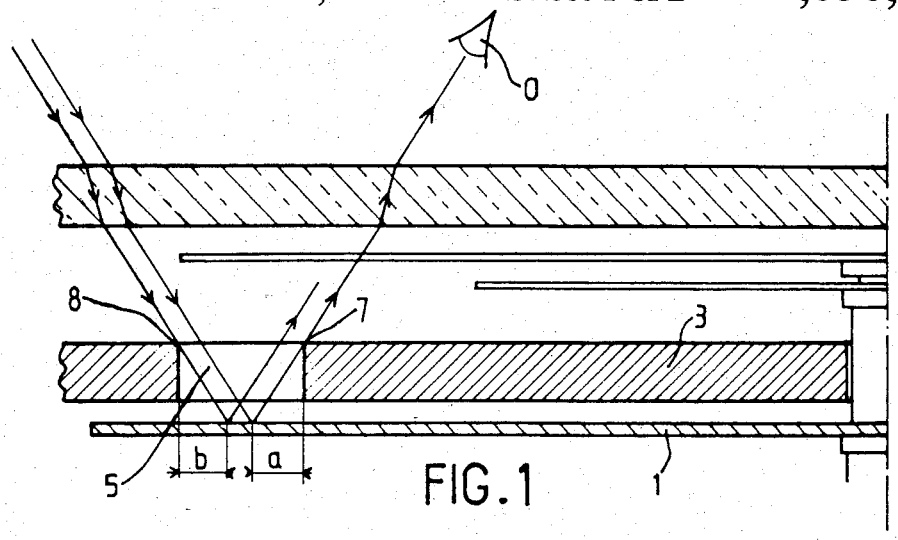
FIG. 1 is a partial axial cross section through a watch of a known type with a date system.

The watch shown in FIG. 1 is a watch of a known type, wherein a disk 1, having the sign to be displayed on its upper face, is driven rotationally by the movement of the watch, and as it rotates, moves opposite a window 5 provided in dial 3. It is clear that, in this watch, the entire part of the image situated in the portion a of the disk is hidden from the view of an observer situated at O by the corner 7 of the window. In addition, as can also be seen in FIG. 1, the part of the image visible through window 5 is not, beyond a given incidence of the light rays, lit in its totality. Indeed, it can easily be seen that part b of the image of the disk protected by edge 8 of the window is situated in a penumbral zone.

In order partially to overcome these two disadvantages, it has been proposed that the apparent thickness of the dial be reduced by providing bevels on the inside edges of the window. However, this arrangement is not entirely satisfactory, especially as, for mechanical reasons (buckling of the rotating disk) it is necessary to provide a relatively large space between the dial and the rotating disk.

It has also been proposed, with a view to improving the ease of reading, that the size of the displayed symbols be increased by a magnifier attached to the crystal of the watch or forming an integral part thereof. In addition to the fact that this solution does not remedy the masking and penumbral defects mentioned above, it even further diminishes the angle at which it is possible for the user to read.

The present invention has the object of overcoming these disadvantages by proposing a display system completely free of the lighting and masking defects mentioned above and which enables the user to read at practically any observation angle.

For this purpose, the object of the invention is a watch or the like equipped with a display device of the date type, wherein the symbols to be displayed are located on a mobile support and are perceived by an observer through a window provided in part of the watch, said watch being characterized by a bundle of coherent optical fibers being fitted in said window so that one end of said bundle is disposed in the vicinity of the mobile support while its other end is flush with a visible face of an element of the watch, which may or may not be the same as the part wherein said window is provided.

This visible face will constitute the reading plane of the display system and may comprise the upper face of the watch dial, the window being provided in this case in said dial at right angles to the mobile support and the bundle of optical fibers flush with the upper surface of the dial.

The reading plane can also be composed of the upper face of the watch crystal, whereby the bundle of optical fibers extends through a window provided in the dial flush with the mobile support, up to the upper surface of the crystal.

The reading plane can finally be composed of an upper surface of the watch case, the window being in this case provided in the body of the case flush with the mobile support, up to an upper surface of the case, with said bundle of fibers being accommodated in this window such as to be flush with said upper face.

Advantageously, an optical bridge composed of a low-viscosity liquid will be placed between the support of the symbols to be displayed and the end abutting the bundle of optical fibers. On the one hand, the clarity of the image of the displayed symbol is improved in this way by avoiding multiple spurious reflections at the surfaces of the fiber bundles and the observation surface. On the other hand, one avoids the risk of scratching adjacent surfaces when the support of the symbols to be displayed is moved, since they can thus be located sufficiently far away with no risk of affecting the clarity adversely. Moreover, in the case where these two surfaces come into contact, the lubrication provided by the liquid will prevent scratches from forming.

In a particularly attractive embodiment of the invention, the bundle of fibers is mounted "floating" on the film of liquid deposited on the disk, its lateral support being provided by the internal walls of the window. It will be seen that, in addition to its simplicity, this embodiment has the advantage of providing a constant space between the bundle of fibers and the disk. As a result, both the risk of scratching and irregularities in the observed image due to differences in the disk's distance from the bundle of fibers are eliminated.

The liquid can rest on the upper face of the support of the symbols to be displayed, or be accommodated in a chamber in said support.

This liquid may be simply an oil of the type used in watchmaking for lubricating small movements.

Other characteristics and advantages of the invention will appear in the detailed description hereinbelow, wherein reference will be made to FIGS. 2 to 8 of the attached drawings.

Figure 2:
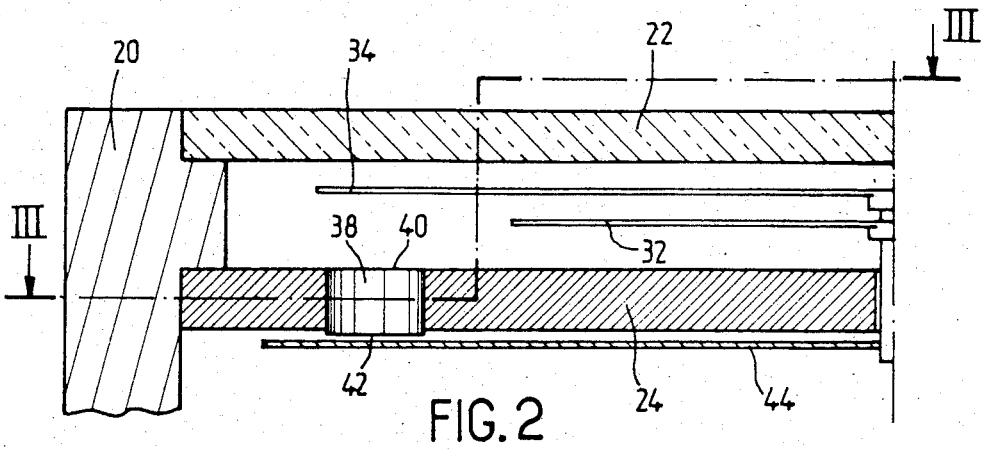
FIG. 2 is a similar section through a watch according to the invention.
Figure 3:
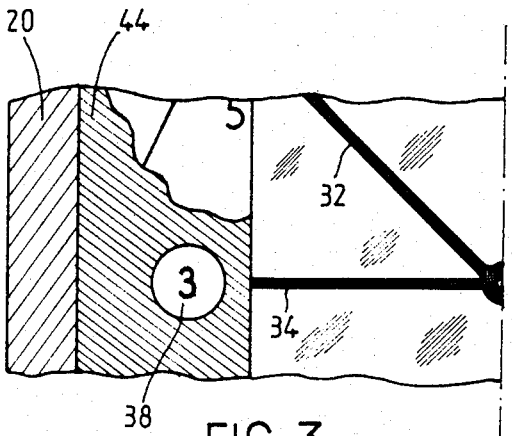
FIG. 3 is a section along line III—III of FIG. 2.

In the watch of FIGS. 2 and 3, case 20 is closed at its upper part by a crystal 22. It supports a dial 24 provided at its center with a hole 26 intended for passage of two shafts 28 and 30 bearing hands 32 and 34, respectively, of the watch. It is also provided with a circular window 36 wherein a bundle of coherent optical fibers 38 is attached, by gluing for example. The upper end 40 of bundle 38 is disposed in the upper plane of dial 24 and its lower end 42 is located at a short distance from the surface of a rotating disk 44 bearing the symbols to be displayed, dates for example. Thus, for the user, symbols will appear, in the same way as the hour indications, not as being situated at the bottom of the chamber, but at the surface of the dial, on which they will stand out clearly, as can be seen in FIG. 3 (see also FIG. 8).

In the embodiments of FIGS. 4 to 7, the elements described in relation to FIG. 2 have the same reference numbers.

Figure 4:
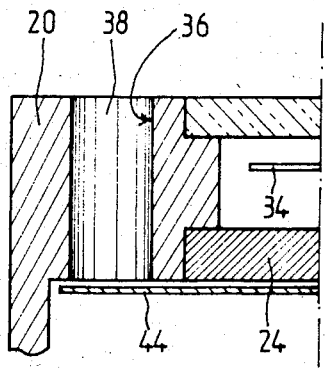
FIGS. 4 and 5 are partial sections, similar to those of FIGS. 1 and 2, of other embodiments of the invention.

In the watch of FIG. 4, window 36 which contains bundle 38 of optical fibers is provided in a lateral part of case 20, flush with disk 44, and the upper end of bundle 38 is flush with the upper surface of the case, which then constitutes the reading plane.

Figure 5:
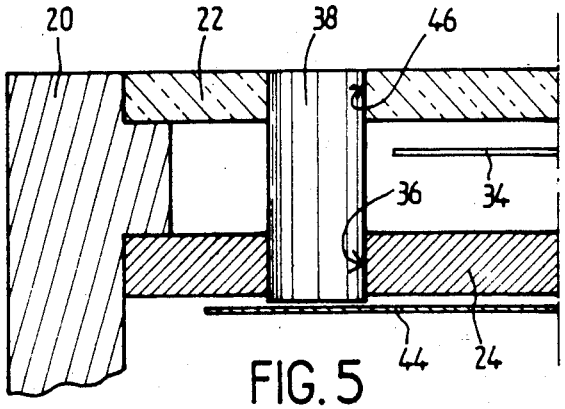

In FIG. 5, window 36 in which bundle of optical fibers 38 is mounted is provided in dial 24, as in the case of the embodiment of FIG. 2, but its upper part is engaged in an opening 46 provided in the crystal 22 of the watch, the outer surface of which is flush with the upper end of said bundle.

Figure 6:
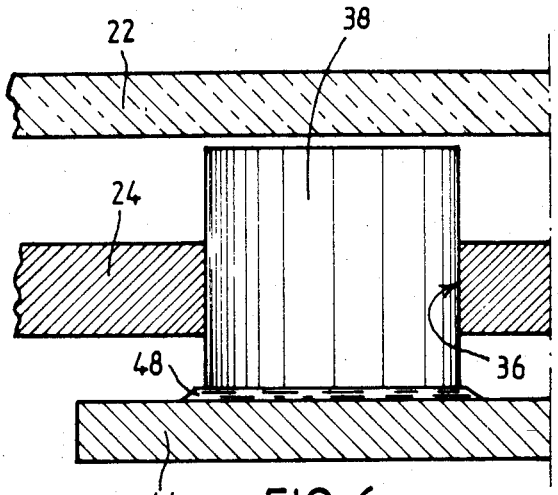
FIGS. 6 and 7 illustrate variant embodiments of the watch in FIG. 2.
Figure 8:
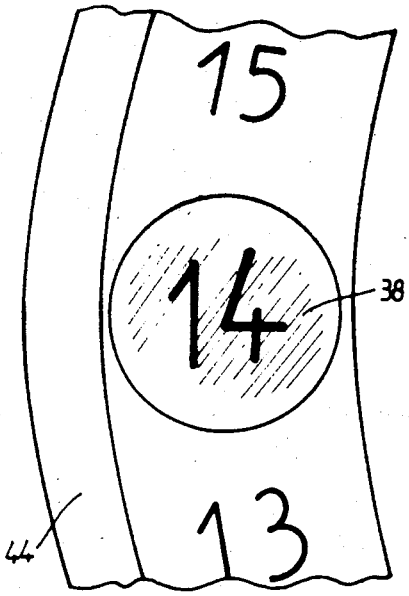
FIG. 8 is a section along line VIII—VIII of FIG. 7
Figure 7:
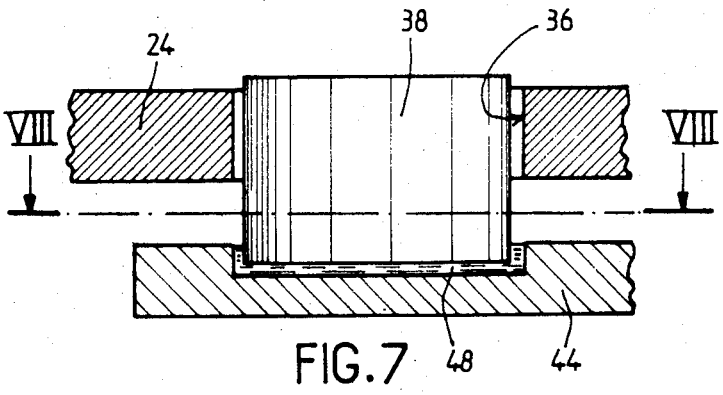

FIGS. 6 and 7 illustrate two embodiments of the watch according to FIG. 2, wherein bundle of optical fibers 38 is still mounted in a window 36 of dial 24, but where an optical bridge, intended to ensure the reading quality of the symbols displayed, is provided between the end of bundle 38 and disk 44.

In the case of FIG. 6, bundle 38 is integral with dial 24 and the surface of rotary disk 44 facing the lower end of said bundle is coated with a liquid 48 with a low index of viscosity, for example a watch movement oil of the type sold by the Mobius Company, product no. 9027. The film of oil is in contact with the adjacent end of bundle 38 and thus provides an optical bridge between the fibers and disk 44. It eliminates or reduces the risk of scratching due to accidental contact between the bundle of fibers and the disk.

In the embodiment of FIG. 7, liquid 48 is disposed in an annular chamber of disk 44, wherein rests the lower end of bundle 38 of optical fibers, and this bundle, instead of being rigidly integral with dial 24 is mounted to float in window 36, whose lateral walls serve simply to guide and support bundle 38. In this case, bundle 38 of fibers can move under the urging of disk 44 while maintaining a constant distance therefrom. This avoids any risk of scratching the disk and/or the end face of the bundle of fibers.

The invention thus provides simple easy-to-implement improvements to watches or the like equipped with a movable display system of the date type, in order to improve observation of the readings in the display system.

I claim:

1. A watch or the like with a display device of the date type, wherein the symbols to be displayed are supported by a mobile support element (44) and are perceived by an observer through a window (36) provided in part of the watch, said watch being characterized by a bundle (38) of coherent optical fibers being mounted in said window such that one end of said bundle is disposed near the mobile support (44) while the other end is flush with a visible surface of an element of the watch and where a film of low-viscosity liquid is interposed between said mobile support element (44) and the contiguous end of the bundle of fibers (38) to provide an optical bridge between said support and said bundle of fibers.

2. A watch according to claim 1, characterized by the part of the watch in which said window (36) is provided and the element of the watch, the surface of said elements being flush with one end of said bundle of fibers (38), constituting one and the same element.

3. A watch according to claim 2, characterized by said element comprising the dial (24) of the watch.

4. A watch according to claim 2, characterized by said element comprising a part (20) of the watch case.

5. A watch according to claim 2 characterized by said bundle of fibers (38) being rigidly integral with said element of the watch.

6. A watch according to claim 1, characterized by the part of the watch in which said window (36) is provided and the element of the watch with whose surface one end of said bundle of fibers (38) is flush, being two separate elements.

7. A watch according to claim 6, characterized by said window (36) being provided in the dial (24) of the watch and by the end of the bundle of fibers being flush with the outer surface of the crystal (22) of the watch.

8. A watch according to claim 6 characterized by said bundle of fibers (38) being rigidly integral with said element and/or said part of the watch.

9. A watch according to claim 1, characterized by said bundle of fibers (38) being mounted floating on said liquid.

10. A watch according to claim 1 characterized by said liquid being disposed at the surface of said mobile support (44).

11. A watch according to claim 1 characterized by said liquid being disposed in an annular chamber (48) of said mobile support (44).

12. A watch according to claim 1 characterized by said bundle of fibers (38) being mounted freely in said window (36).

* * * * *